United States Patent [19]

Matsuda et al.

[11] 4,074,644

[45] Feb. 21, 1978

[54] FEED MECHANISM FOR SEWING MACHINE

[75] Inventors: Kimikazu Matsuda; Yoshihiro Yamaguchi, both of Osaka, Japan

[73] Assignee: Maruzen Sewing Machine Co., Ltd., Moriguchi, Japan

[21] Appl. No.: 744,315

[22] Filed: Nov. 23, 1976

[30] Foreign Application Priority Data

Dec. 20, 1975 Japan ..... 50-172345[U]
Dec. 22, 1975 Japan ..... 50-154187

[51] Int. Cl.[2] ..... D05B 27/02
[52] U.S. Cl. ..... 112/215
[58] Field of Search ..... 112/215, 216, 203

[56] References Cited

U.S. PATENT DOCUMENTS

| | | | |
|---|---|---|---|
| 470,092 | 3/1892 | Woodward | 112/215 |
| 3,081,720 | 3/1963 | Patten | 112/203 |
| 3,527,183 | 9/1970 | Szostak | 112/215 |
| 3,534,696 | 10/1970 | Willenbacher et al. | 112/215 |
| 3,921,552 | 11/1975 | Daman et al. | 112/215 |

FOREIGN PATENT DOCUMENTS

| | | | |
|---|---|---|---|
| 50,780 | 3/1965 | Germany | 112/215 |
| 445,275 | 2/1968 | Switzerland | 112/215 |

*Primary Examiner*—George H. Krizmanich
*Attorney, Agent, or Firm*—Arnstein, Gluck, Weitzenfeld & Minow

[57] ABSTRACT

Mechanism in a sewing machine for actuating the feed dog includes a pivoted actuating arm carrying on its distal end a feed dog support which is rockable about a vertical axis and also is slidable vertically. The feed dog support includes an arm which cooperates with an arcuate guideway which controls the attitude of the feed dog support so that the feed dog is maintained in proper work feeding attitude in its horizontal movement. Additional means effect vertical movement of the feed dog support in synchronism with the horizontal movement.

5 Claims, 5 Drawing Figures

FEED MECHANISM FOR SEWING MACHINE

BACKGROUND OF THE INVENTION

The present invention relates to improvements in actuating mechanism for the feed dog of a sewing machine.

One of the objects of this invention is the provision, in a sewing machine, of novel means for actuating the feed dog and controlling the attitude of the feed dog, in its operation, so that the feed dog is maintained in proper work feeding attitude.

Another object of this invention is the provision of novel means for actuating the feed dog of a sewing machine, particularly, of the free arm type, which, because of its construction, has limited space for accommodating the operating mechanism in the bed portion of the machine.

Other and further objects of this invention will become apparent from the following description considered in connection with the accompanying drawings.

DESCRIPTION OF THE PREFERRED EMBODIMENT

Figure 1:
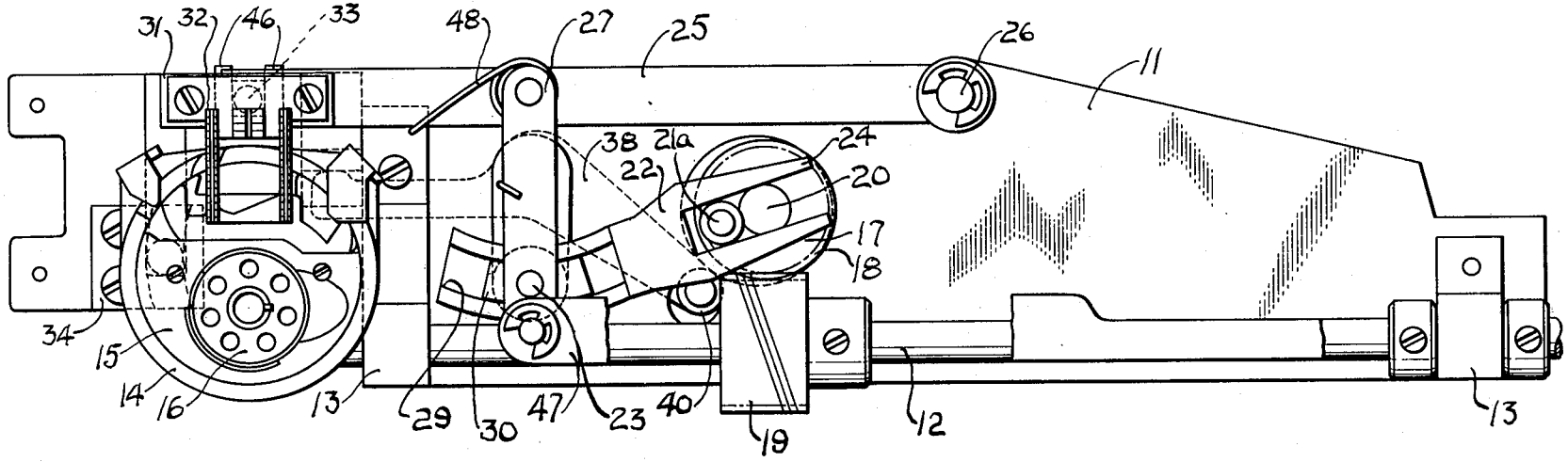
FIG. 1 is a top plan view of the mechanism in the base or lower arm of the sewing machine for actuating the feed dog.

The present invention as illustrated in the drawings is embodied in a free-arm type sewing machine which includes in the work arm a base member 11 having a rotary drive shaft 12 journalled in bearing members 13 supported on said base member. In the usual manner, the shaft 12 is designed to actuate the loop taker and feed lift mechanism, hereinafter to be described, and is itself driven by any suitable means, not shown. A rotary hook body or loop taker 14 is operatively connected with the shaft 12 and is rotated in one direction thereby. A bobbin case 15 is contained within the rotary hook body and received in said case is a bobbin 16.

Figure 3:
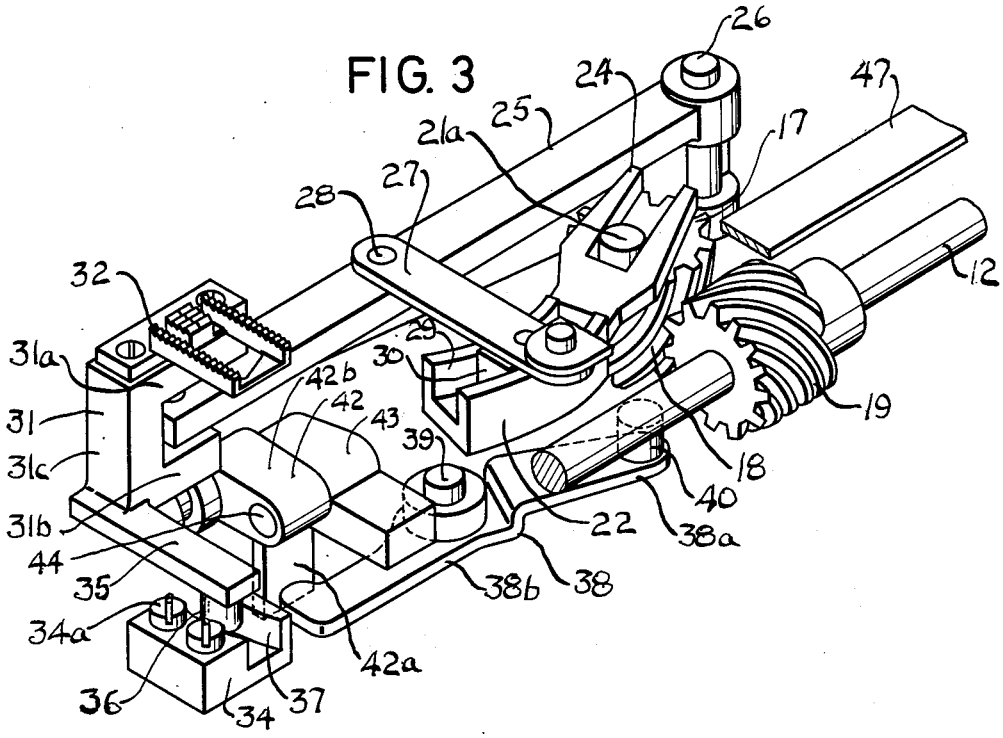
FIG. 3 is a perspective view of the mechanism shown in FIG. 2, with certain parts eliminated for purposes of clarity.
Figure 4:
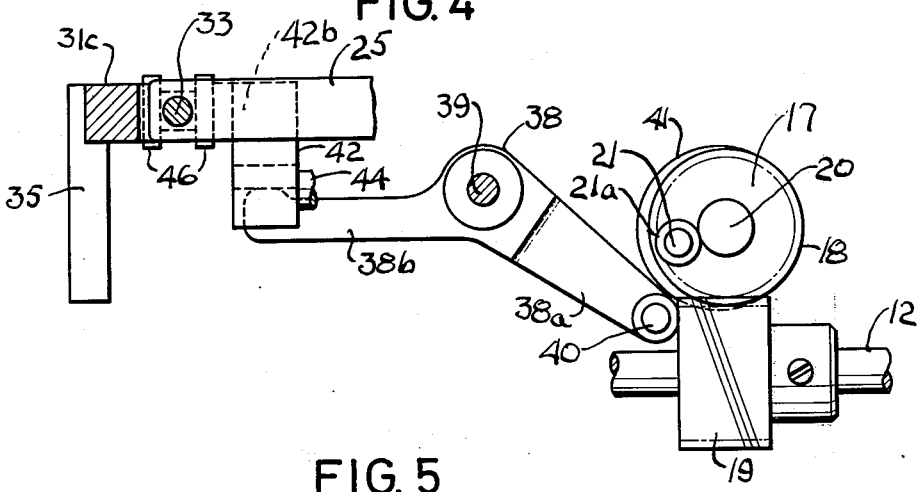
FIG. 4 is a fragmentary top plan view of certain parts of the mechanism which function to impart vertical movement of the feed dog.
Figure 5:
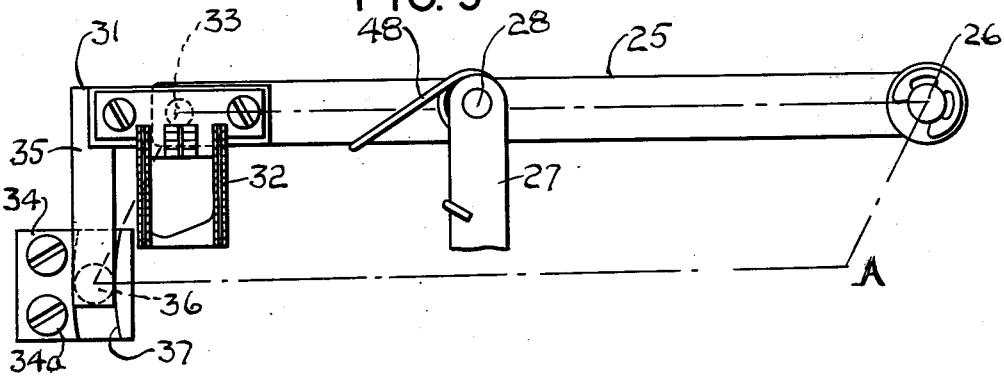
FIG. 5 is a fragmentary plan view of certain of the structural details as shown in FIG. 3.

A rotary member 17 which includes a helical gear 18 is rotatably supported on shaft 20 secured in the base member 11. The gear 18 cooperates with a worm 19 fixed on drive shaft 12. The rotary member 17 carries on its upper surface an upstanding pin 21 carrying a roller **21*a* and disposed eccentric to the axis of shaft 20. A slide block guide 22, shaped substantially as illustrated in FIGS. 1 and 3, is supported on vertical shaft 23 secured in the base member 11. The block guide 22 includes an integral forked portion 24 which embraces the roller 21*a*. Rotation of the rotary member 17 will effect rocking of the block guide 22 about the axis of shaft 23**.

A lever 25 is rockably supported at one end on shaft 26 carried on base member 11. A connecting link 27 is pivotally secured, at one end, by a pin 28 to an intermediate portion of lever 25 and, at the other end, to a slide block 30 received in the guideway 29 of the block guide 22. As will be seen in FIG. 1, guideway 29 and slide block 30 have the same radius of curvature, with the center being the axis of shaft 28. Thus, angular movement of the link 27 about the axis of shaft 28 will not effect relative movement between block guide 22 and lever 25.

Figure 2:
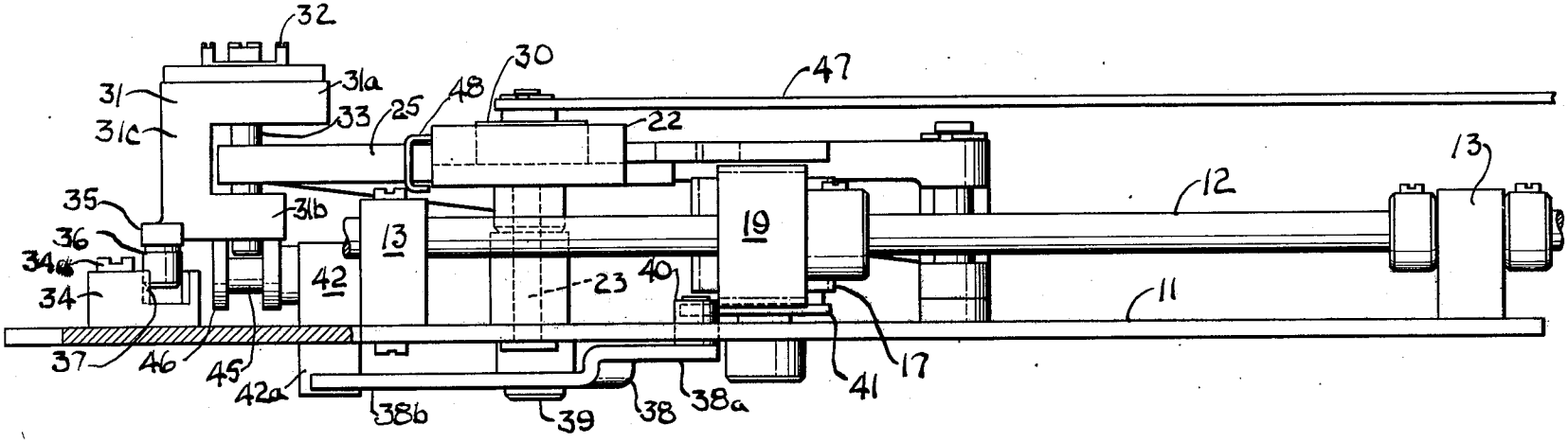
FIG. 2 is an elevational view with certain parts omitted for greater clarity.

A feed dog 32 is mounted on the upper surface of a support member 31. As seen clearly in FIGS. 2 and 3, the support member 31 includes a pair of spaced parallel horizontal arms **31*a* and 31*b* integral with a vertical portion 31*c*. The support member 31 has a rigid forwardly extending arm 35 which is provided at its distal end with a depending roller 36. The arms 31*a* and 31*b* are drilled vertically to receive a pin 33 which is fixed in said arms with the lower end of the pin projecting below the arm 31*b*. As seen in FIG. 2, the distal end of the lever 25 is drilled to slidably accommodate the pin 33, the lever 25 being received in the space between the arms 31*a* and 31*b*. It will be noted that said space is considerably greater than the thickness of arm 25 so as to afford clearance for vertical movement of the feed dog support 31 relative to arm 25**.

A guide member 34 is adjustably secured to the base member 11 as with screws **34*a*. Said guide member has an arcuate guideway 37 in which is slidably received the roller 36. The configuration of the guideway 37 constitutes part of a circle having a radius whose center is point A. The length of this radius is measured between point A and the center line of guideway 37 and is equal to the distance between the axes of pins 26 and 33. Also, the distance between point A and the axis of shaft 26 is equal to the distance between the axes of pins 33 and 36. Thus, in essence, the parts function in the nature of parallelogram linkage arrangement controlling the attitude of the feed dog 32** so that it is always disposed in proper relation to the direction of feed and without deviation therefrom.

A crank lever 38 is pivoted on shaft 39 secured to the underside of base member 11. A follower roller 40 is carried on the end of one of the arms **38*a* of the crank lever and is adapted to engage against a cam 41 fixed on the lower end of rotary member 17. The terminal end of the other arm 38*b* of the crank lever 38 is adapted to engage against the depending arm 42*a* of a crank lever 42, presently to be described. It will be apparent that rocking movement of the crank lever 38 will be influenced by rotation of cam 41. The high point of cam 41 is disposed in a particular relation to roller 21*a* so as to obtain a desired optimum feed travel of the feed dog 32**, as will be hereinafter more fully explained.

The crank 42 is pivotally supported on a horizontal shaft 44 which is carried on a member 43 supported on the base support 11. The arm **42*b* of crank lever 42 is disposed substantially at right angle to the depending arm 42*a* and is provided at its end with a laterally extending pin 45 carrying a pair of rollers 46 arranged in spaced relation so as to accommodate therebetween the lower end of pin 33. The rollers 46 engage against and support the feed dog support 31 and, as will be apparent, any movement imparted to the crank lever 42 by crank 38 will effect vertical movement of the feed dog support 31**.

As seen in FIGS. 1 and 2, an actuating bar 47 is pivotally connected, at one end, to an end of the connecting link 27, the other end of the actuating bar being connected to a conventional adjusting dial, not shown. As will be apparent, movement of the actuating bar 47 longitudinally thereof will effect rocking of the connecting link 27 about the pin 28 to selectively position the slide 30 within the guideway 29. This adjustment determines the length of movement of the feed dog in a horizontal direction and correspondingly determines the length of the stitch and the rate of feeding of the fabric through the machine.

A torsion spring 48 circumposed about the pin 28 engages the lever 25 and connecting link 27 and serves to bias the link 27 in a counterclockwise direction as viewed in FIG. 1.

The operation of the mechanism described above is as follows:

Rotation of the drive shaft 12 will effect rotation of the rotary member 17 to cause the slide block guide 22 to rock about its shaft 23 imparting motion through the connecting link 27 to the lever 25 causing the feed dog support 31 to reciprocate in a horizontal direction. However, as was hereinabove explained, the guideway 37 in which the roller 36 is received will control the attitude of the feed dog support 31 in such horizontal direction so as to maintain the feed dog in proper work feed relation. In its movement the feed dog support 31 is caused to rock about the vertical axis of pin 33 relative to the lever 25, so that even though the pin 33 travels in an arc, the center of which is the axis of shaft 26, the feed dog support 31 is restrained from assuming an improper angular position by the guideway 37. Accordingly the dog 32 always is disposed in proper work feed relation in its horizontal movement. Correspondingly cam 41 acting on roller 40 will effect rocking of the crank 38 about the axis of pin 39. Such movement effects rocking of the crank lever 42 about the axis of pin 44 causing the rollers 46 to move of the feed dog support 31 vertically. In such movement, the feed dog 32 moves vertically, up and down, in synchronism with the horizontal movement, hereinbefore described.

Adjustment of stitch length is effected upon movement of the slide block 30 within the guideway 29 through the instrumentality of the actuating bar 47.

Various changes coming within the spirit of our invention may suggest themselves to those skilled in the art; hence, we do not wish to be limited to the specific embodiments shown and described or uses mentioned, but intend the same to be merely exemplary, the scope of our invention being limited only by the appended claims.

We claim:

1. An actuating mechanism for the feed dog of a sewing machine comprising a rigid lever mounted for rocking movement about a first fixed vertical axis and having an aperture at its distal end, a driving element, means operatively connecting said lever with said driving element for imparting oscillating rocking movement to said lever, a feed dog support carrying a feed dog, said support having a horizontal slot and a vertical pin bridging said slot with the pin passing through the opening in the lever, the axis of said pin constituting a second vertical axis, the feed dog support thereby being oscillative angularly and vertically on said second vertical axis relative to said lever, an arcuate guideway for controlling the attitude of said feed dog support, the radius of curvature of said guideway being equal to the radial distance between said first and second vertical axes, a control arm rigid with said feed dog support and having an end portion received in said guideway, said feed dog support when oscillated by said lever being caused to be rocked by said guideway about said second vertical axis relative to said lever so as to maintain the feed dog substantially in a straight line work feeding attitude, and means operatively connecting said driving element with said feed dog support for oscillating said feed dog support vertically in synchronism with its angular oscillating movement.

2. An actuating mechanism for the feed dog of a sewing machine comprising a rigid lever mounted for rocking movement about a first fixed vertical axis and having an aperture at its distal end, a driving element, a rotary member driven by said driving element and carrying a roller disposed eccentric to the axis of said rotary member, a slide block guide supported for oscillating movement about an axis parallel to the axis of the rotary member and having a forked portion embracing said roller, a block slidably received in said block guide, a link connecting said block with said lever for transmitting horizontal oscillating movement to said lever, a feed dog support carrying a feed dog, said support having a horizontal slot and a vertical pin bridging said slot with the pin passing through the opening in the lever, the axis of said pin constituting a second vertical axis, the feed dog support thereby being oscillative angularly and vertically on said second vertical axis relative to said lever, an arcuate guideway for controlling the attitude of said feed dog support, the radius of curvature of said guideway being equal to the radial distance between said first and second vertical axes, a control arm rigid with said feed dog support and having an end portion received in said guideway, said feed dog support when oscillated by said lever being caused to be rocked by said guideway about said second vertical axis relative to said lever so as to maintain the feed dog substantially in a straight line work feeding attitude, and means operatively connecting said driving element with said feed dog support for oscillating said feed dog support vertically in synchronism with its angular oscillating movement.

3. The invention as defined in claim 2 in which the last mentioned means includes a cam carried on said rotary member, a first crank lever pivoted on a vertical axis and having one end engaged with said cam, a second crank lever pivoted on a horizontal axis and having one end engaged with the opposite end of the first crank lever, said feed dog support resting on the opposite end of the second crank lever, the cam when rotated effecting vertical oscillation of the feed dog support in synchronism with the angular oscillation of the feed dog support.

4. The invention as defined in claim 3 in which the opposite end of the second crank lever carries a pair of spaced rollers engaging said feed dog support.

5. The invention as defined in claim 4 in which the vertical pin has a lower depending portion disposed between said rollers.

* * * * *